US005171975A

United States Patent [19]

Lyga

[11] Patent Number: 5,171,975

[45] Date of Patent: Dec. 15, 1992

[54] TAPE FEED DEVICE

[75] Inventor: Thomas M. Lyga, Torrington, Conn.

[73] Assignee: Pitney Bowes Inc., Stamford, Conn.

[21] Appl. No.: 741,364

[22] Filed: Aug. 7, 1991

[51] Int. Cl.[5] ..... G07G 1/00

[52] U.S. Cl. ..... 235/101; 101/91; 400/664

[58] Field of Search ..... 235/101; 101/91; 400/569, 663, 664

[56] References Cited

U.S. PATENT DOCUMENTS 3,556,001 1/1971 Kinney et al. ..... 235/101
3,583,314 6/1971 Gillender et al. ..... 235/101
4,922,085 5/1990 Dannatt et al. ..... 235/101

*Primary Examiner*—Michael L. Gellner
*Assistant Examiner*—Eddie C. Lee
*Attorney, Agent, or Firm*—Charles G. Parks, Jr.; Melvin J. Scolnick

[57] ABSTRACT

A postage meter mailing machine including a tape feed assembly positioned within the postage meter mailing machine between a home position and a second position. The tape feed assembly rotatably supports first and second rollers and associated drive gear assemblies in meshed gear engagement for feeding tape through the tape feed assembly. A locking assembly is provided for locking the drive gear assemblies when the tape feed assembly is travelling between its home and second position such that the drive gear is unlocked only when the tape feed assembly is in said home position.

2 Claims, 3 Drawing Sheets

TAPE FEED DEVICE

RELATED APPLICATION

This patent application relates to U.S. patent application Ser. No. 607,414 entitled IMPROVED TAPE FEED DEVICE FOR A POSTAGE METER MAILING MACHINE now U.S. Pat. No. 5,142,127.

BACKGROUND OF THE INVENTION

The present invention relates to a displaceable tape feed assembly for a postage meter mailing machine. A tape feed assembly particularly suited for use as a module of a postage meter mailing machine as described in U.S. patent application Ser. No. 607,414. The tape feed assembly includes a tape track and aligning cam rod. The tape feed assembly is slidable mounted to and supported by the tape track and cam rod such that rotation of a tape track motor causes the tape assembly to be positionable from a home position to a second position by the cam rod. The tape assembly includes a drive gear assembly which is only brought into engagement when the tape feed assembly is in the home position, the drive assembly being driven by a second motor. In the home position, the tape feed assembly upon initiation of the second motor is caused to motivate tape into the tape feed assembly.

It has been determined that tape, which is fed in the tape track when the tape assembly is in the home position, is caused to reposition or slip when the tape track is displaced to its second position during tape printing. This repositioning of the tape causes an error in the location of the printed information on the tape.

SUMMARY OF THE INVENTION

It is an objective of the present invention to present an improved tape feed assembly having braking means to prevent tape slippage during printing of the tape track in its second position.

The tape feed assembly includes a feed carriage assembly slidably mounted on rails. The rails are mounted to a support structure within the mailing machine. A cam rod having a cam track is also mounted rotatively to the support structure. The tape feed carriage assembly includes a cam follower which, upon rotation of the cam rod by a suitable motor, causes the tape feed assembly to displace between a home position and a second position.

The tape feed assembly includes a feed carriage which rotatively supports oppositely and parallel feed roller assemblies. Each feed roller assembly includes a respective gear. The gears of the respective roller assemblies are maintained in constant mesh.

A lock assembly is mounted within the feed carriage and includes a lever pivotally mounted in the feed carriage. At a point along the lever is mounted an interposer pin and at another point along the lever is formed a release tab such that in the home position, the release tab is acted upon by a stricker to cause the lever to position the interposer pin clear of the roller assembly gears. Upon displacement of the feed carriage to its second position, the lever is biased by a spring to cause the interposer pin to be positioned between adjacent ones of the gear teeth and thereby lock each feed roller in position to prevent tape slippage.

DETAILED DESCRIPTION OF THE INVENTION

Figure 1:
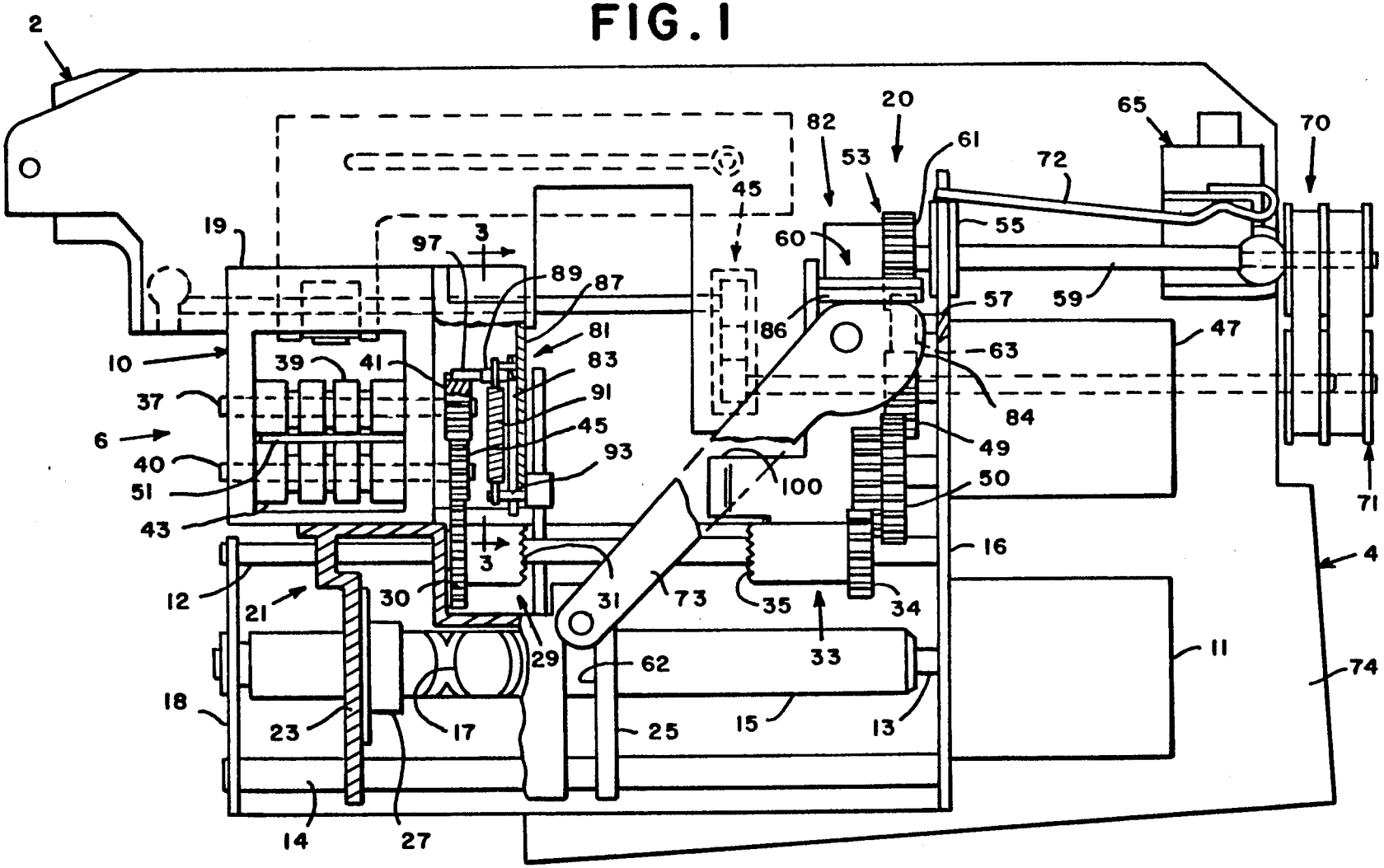
FIG. 1 is a partially sectioned and partly broken away side view of a support structure for a postage meter seated in the meter pocket and a tape feed assembly including the lock assembly which is further depicted in FIGS. 3 and 4 in accordance with the present invention.
Figure 3:
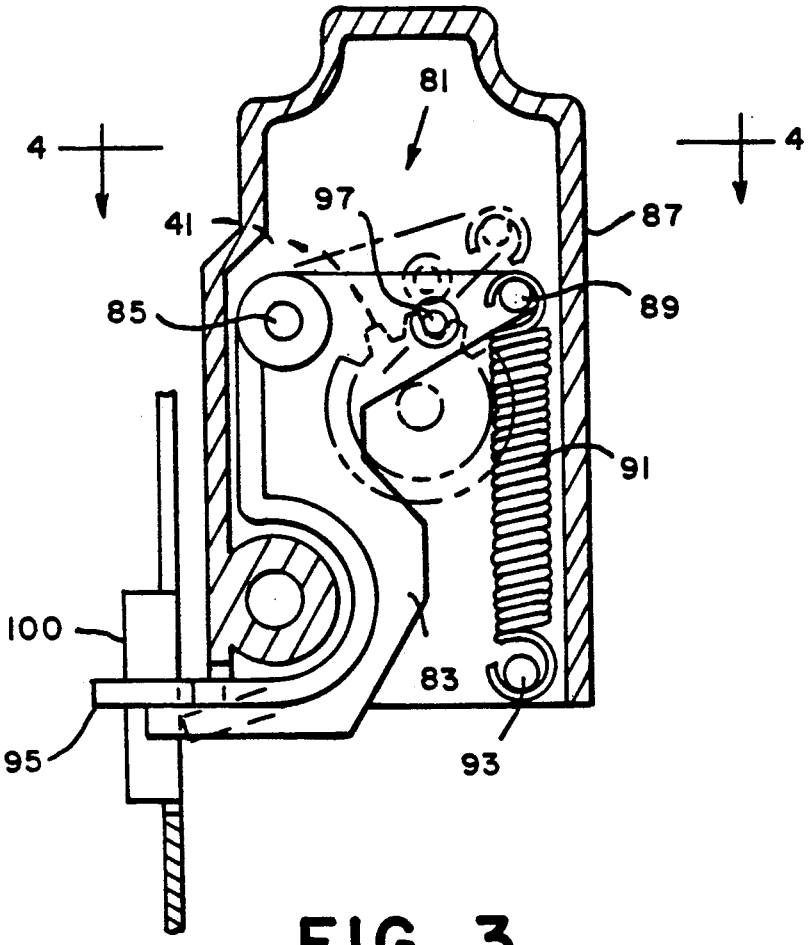
FIG. 3 is a side sectional view along line 3—3 of the tape feed lock assembly in accordance with the present invention.

Referring to FIGS. 1 and 3, illustrated is a suitable postage meter 2 which is mounted in a mailing machine support structure, generally indicated as 4, and a suitable tape feed assembly, generally indicated as 6. A further detailed description may be found in U.S. patent application Ser. No. 607,414 entitled IMPROVED TAPE FEED DEVICE FOR A POSTAGE METER MAILING MACHINE, filed Oct. 31, 1990, and herein incorporated by reference.

Briefly, the tape dispensing assembly 6 is comprised of a tape feed carriage assembly 10. The feed carriage assembly 10 is slidably supported on rails 12 and 14, respectively. The rails 12 and 14 are fixably mounted respectively at one to mailing machine support wall 16 and at their other end to support wall 18. A first drive motor 11 is fixably mounted to the support wall 16 having an output shaft 13 coupled to one end of a cam rod 15. The cam rod 15 includes a formed cam track 17. The cam rod 15 is rotatively supported at its other end in support wall 18.

The feed carriage assembly 10 includes a frame 19 mounted in a suitable manner such as described in U.S. patent application Ser. No. 607,414 to permit the frame 19 to be vertically displaced from support linkage 21 for printing by the postage meter 2 when the feed carriage assembly is in the second position. The support linkage 21 also includes vertical support links 23 and 25. The rail 12 extends through aligned apertures in the respective support links 23 and 25 such that the support linkage 25 can be slidably displaced along rail 12. The cam rod 15 also extending through respectively aligned apertures in support links 23 and 25. A C-sided (not shown) is formed in the lower end of the respective support links 23 and 25 to extend partially around the rail 14. The support link 23 has fixably mounted thereto a cam collar 27 positioned around the cam rod 15 such that upon rotation of the cam rod 15 by motor 11, the follow (not shown) of the cam collar 27 tracks in the cam track 17 in a conventional manner to cause the carriage assembly 6 to reciprocally displace laterally along rails 12 and 14 between a home and second position.

Rotatively mounted to the support link 25 around rail 12 by any conventional means is a gear hub 29 having radial gear 30 and axial gear 31. The rail 12 has rotatively mounted therearound by any conventional means a gear hub 33 having radial gear 34 and axial gear 35. The gear hubs 29 and 33 are aligned on the rail 12 such that when the carriage assembly 10 is in the home position, gears 31 and 33 are brought into engaging contact.

The frame 19 rotatively supports a first and second shafts 37 and 40, respectively. Fixably mounted around respective portions shaft 37 is a roller 40 and a gear 41. In like manner, a roller 43 and gear 45 are fixably mounted around shaft 39 such that the rollers 39 and 43 are radially aligned and gears 41 and 45 are maintained in radial engagement.

A second motor 47 having a output drive gear 49 is fixably mounted to the support wall 16. A gear set 50 is rotatively mounted to the support wall 16 and provides intermediate communication between gear 49 and 34. It is now apparent that positioning of the carriage assembly 6 in the home position by motor 11 brings gears 31 and 34 into engaging contact. Actuation of motor 47 can then cause tape 51 to be advanced through the frame 19 by rollers 39 and 43.

Figure 2:
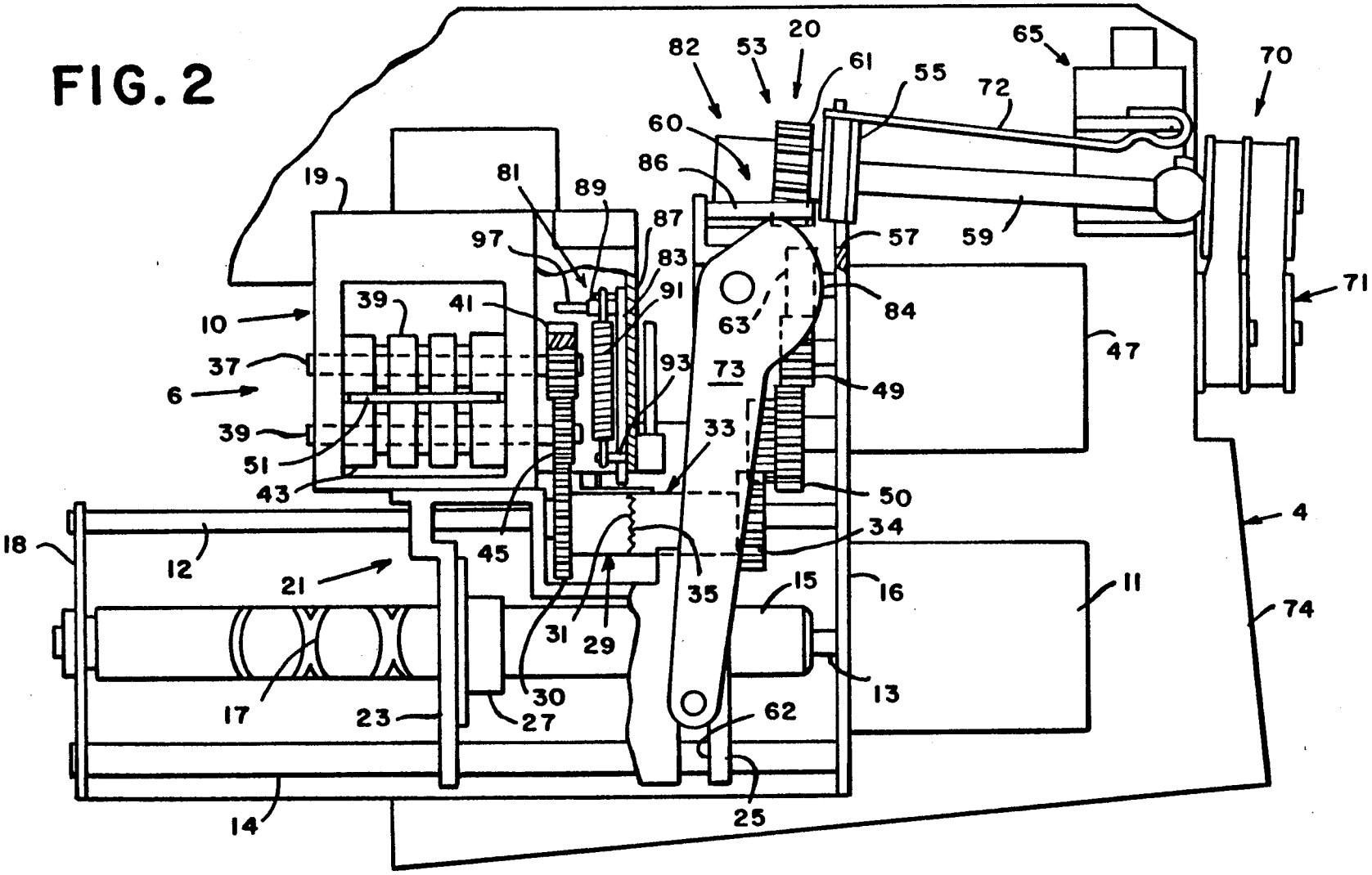
FIG. 2 is a partially sectioned side view of the tape feed assembly in the home position in accordance with the present invention.

A drive assembly 20 includes a gear assembly 53 which is more fully described in U.S. patent application Ser. No. 607,414. Briefly, the drive assembly 53 includes a slide plate 55 slidably captured in a slot 57 formed in support wall 16. Rotatively mounted in the slide plate 55 is a shaft 59. At one end of shaft 59 is rotatively mounted a disengaging and engaging assembly 60 which includes gear 61. A gear 63 is rotatively mounted to the wall 16 and is maintained in constant mesh with gear 49. The gear 63 is also aligned to for engagement with gear 61. A bracket 65 is fixably mounted to wall 74 which pivotally and rotatively supports the shaft 59. Fixably mounted to the other end of the shaft 59 are belt couplers 70 in respective belt communication with couplers 71 for driving the meter engaging mechanism 45. A leaf spring 72 is affixed to the bracket 65 and extends to contact the slide plate 55 for urging the slide plate 55 downwardly in the slot 57. Referring to FIGS. 1 and 2, to improve the stability of the tape feed assembly 6 in the home position, the support linkage 21 further includes a slot 62. A stricker link 73 has one end slidably capture in the slot 62 by any conventional means. The other end of stricker link 73 is pivotally mounted in a bracket assembly 82 fixably mounted to the wall 74. A camming surface 84 is formed at one end of the stricker link 73 such that pivotal displacement of the stricker link 73 causes the camming surface 84 to displace a transfer member 86 resulting in disengagement of gear 61. In this case, the motor 47 is employed to drive the tape feed assembly 10. When the tape feed assembly 10 is in the second position, the spring 72 forces gears 61 into engagement with gear 63. The motor 47 can then be used to drive the mechanism 45. A detailed description of the disengagement of gear assembly 53 is set forth in U.S. patent application Ser. No. 690,477 entitled LOCKING DEVICE FOR REMOVABLE POSTAGE METER HAVING IMPROVED DRIVING COUPLINGS, herein incorporated by reference.

Figure 4:
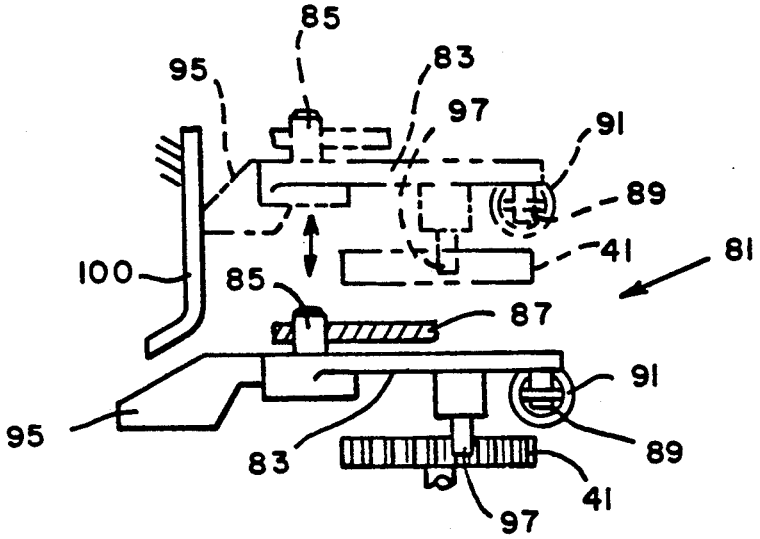
FIG. 4 is a top section view along line 4—4 of the tape feed lock assembly in accordance with the present invention.

Referring to FIGS. 3 and 4, a brake assembly 81 includes a lever 83 pivotally mounted at a point along its length to a hub 85 formed in wall 87 of the tape carriage 10. At one end of the lever 83 is formed a hub 89 around which one end of a tension spring 91 is attached. The other end of spring 91 is attached around a hub 93 formed in wall 87. At the other end of lever 83 is formed a strick flange 95. Fixably mounted on the lever 83 to extend perpendicularly therefrom is a lock pin 97.

It is now appreciated that when the tape carriage 10 is positioned in the home position, the strick flange 95 is displaced by a stricker 100 support assembly 4. The lever 83 is thereby caused to pivot about hub 85 and thereby displace the locking pins 97 for interference with gear 41. When displacement of the tape carriage 20 is partially displaced from the home position, the lever 83 is pivoted by spring 91 to bring the locking pin 97 in interposed position with the gear 41 and thereby locking the rollers 37 and 39 to prevent tape 51 slippage.

What is claimed is:

1. An improved combination of a mailing machine base having a postage meter, and a tape feed assembly positioned between a home position and a second position, said tape feed assembly having a first frame section and second frame section, said first frame section rotatably supporting first and second roller drive gear assemblies in meshed gear engagement;

said improvement comprising means for locking said drive gear assemblies when said first frame section is travelling between said home and second position such that said drive gear are unlocked only when said first frame section is in said home position.

2. An improved tape feed assembly as claimed in claim 1, wherein locking means comprises a lever pivotally mounted in said frame having a locking pin aligned to be positioned by said lever in a first interposing position to a respective one said gears and a second non-interposing position, means for biasing said lever in a first direction for interposing of said pin, and means for causing said lever to assume a second position when said first frame is in the home position.

* * * * *